US007790021B2

(12) United States Patent
Kocal et al.

(10) Patent No.: US 7,790,021 B2
(45) Date of Patent: Sep. 7, 2010

(54) REMOVAL OF SULFUR-CONTAINING COMPOUNDS FROM LIQUID HYDROCARBON STREAMS

(75) Inventors: Joseph A. Kocal, Glenview, IL (US); Jeffrey C. Bricker, Buffalo Grove, IL (US); Gavin P. Towler, Inverness, IL (US)

(73) Assignee: UOP LLC, Des Plaines, IL (US)

( * ) Notice: Subject to any disclaimer, the term of this patent is extended or adjusted under 35 U.S.C. 154(b) by 237 days.

(21) Appl. No.: 11/851,819

(22) Filed: Sep. 7, 2007

(65) Prior Publication Data

US 2009/0065399 A1 Mar. 12, 2009

(51) Int. Cl.
*C10G 19/02* (2006.01)

(52) U.S. Cl. ..... 208/230; 208/226; 208/227; 208/228

(58) Field of Classification Search ..... 208/196, 208/208 R, 226, 228, 229, 230, 232, 240, 208/227
See application file for complete search history.

(56) References Cited

U.S. PATENT DOCUMENTS 3,505,210 A * 4/1970 Heimlich et al. ..... 208/228
5,001,270 A 3/1991 Zemlanicky et al.
5,910,440 A * 6/1999 Grossman et al. ..... 435/282
6,277,271 B1 8/2001 Kocal
6,368,495 B1 4/2002 Kocal et al.
7,179,368 B2 2/2007 Rabion et al.
2003/0102252 A1* 6/2003 Rabion et al. ..... 208/208 R

* cited by examiner

*Primary Examiner*—Walter D Griffin
*Assistant Examiner*—Renee Robinson
(74) *Attorney, Agent, or Firm*—James C Paschall

(57) ABSTRACT

An improved method for desulfurizing a fuel stream such as a diesel stream is disclosed which includes generation of a sulfone oil, the desulfurization of the sulfone oil and the recycling of the resulting biphenyl-rich stream and ultra-low sulfur diesel streams. The method includes combining a thiophene-rich diesel stream with an oxidant to oxidize the thiophenes to sulfones to provide a sulfone-rich diesel stream. Sulfone oil is extracted from the sulfone-rich diesel stream to provide sulfone oil and a first low-sulfur diesel stream The low-sulfur diesel stream is recycled. The sulfone-rich oil stream is combined with an aqueous oxidant-containing stream, such as caustic stream, which oxidizes the sulfones to biphenyls and forms sulfite to provide a second low-sulfur diesel stream.

20 Claims, 1 Drawing Sheet

REMOVAL OF SULFUR-CONTAINING COMPOUNDS FROM LIQUID HYDROCARBON STREAMS

BACKGROUND

1. Technical Field

Processes and apparatuses for removing organic sulfur compounds (e.g., thiophenes) from liquid hydrocarbon streams are disclosed. After subjecting a liquid hydrocarbon stream to oxidation conditions, thereby oxidizing at least a portion of the organic sulfur compounds (e.g., oxidizing thiophenes to sulfones), the oxidized organic sulfur compounds are reacted with caustic (e.g., sodium hydroxide, potassium hydroxide, etc.) to produce sodium sulfite organic compounds.

2. Description of the Related Art

The presence of sulfur in petroleum fuels is a major environmental problem. Indeed, the sulfur is converted through combustion into various sulfur oxides that can be transformed into acids, thus contributing to the formation of acid rain $SO_x$ emissions also reduce the efficiency of catalytic converters in automobiles. Furthermore, sulfur compounds are thought to ultimately increase the particulate content of combustion products.

Because of these issues, reduction of the sulfur content in hydrocarbon streams has become a major objective of environmental legislation worldwide. For instance, Canada, Japan, and the European Commission have all recently adopted a 0.05 wt % limit on sulfur in diesel fuels. In Sweden and the United States (in particular, California), the total sulfur content of gas oils is limited to 0.005 wt %. This limitation could eventually become the standard in the countries belonging to the OECD. In France, the total sulfur content in gasoline is currently limited to 0.05 wt %, but this limit is anticipated to be lowered to 0.005 wt % for all of Europe.

Refiners typically use catalytic hydrodesulfurizing ("HDS", a.k.a. "hydrotreating") methods to lower the sulfur content of hydrocarbon fuels. In HDS, a hydrocarbon stream that is derived from a petroleum distillation is treated in a reactor that operates at temperatures ranging between 575 and 750° F. (~300 to ~400° C.), a hydrogen pressure that ranges between 430 to 14,500 psi (3000 to 10,000 kPa or 30 to 100 bats) and hourly space velocities that range between 0.5 and 4 $h^{-1}$. Thiophenes in the feed react with the hydrogen when in contact with a catalyst arranged in a fixed bed that comprises metal sulfides from groups VI and VIII (e.g., cobalt and molybdenum sulfides or nickel and molybdenum sulfides) supported on alumina. Because of the operating conditions and the use of hydrogen, these methods can be costly both in capital investment and operating costs.

Unfortunately, HDS or hydrotreating often fails to provide a treated product in compliance with the current strict sulfur level targets. This is due to the presence of sterically hindered sulfur compounds such as unsubstituted and substituted thiophenes that act as refractory compounds in hydrotreating environments. For example, it is particularly difficult to eliminate traces of sulfur using such catalytic processes when the sulfur is contained in molecules such as dibenzothiophene with alkyl substituents in position 4, or 4 and 6. Attempts to completely convert these species, which are more prevalent in heavier stocks such as diesel fuel and fuel oil, have resulted in increased equipment costs, more frequent catalyst replacements, degradation of product quality due to side reactions, and continued inability to comply with sulfur requirements.

One attempt at solving the thiophene problem discussed above includes selectively desulfurizing thiophenes contained in the hydrocarbon stream by oxidizing the thiophenes into a sulfone in the presence of an oxidizing agent, followed separating the sulfone compounds from the rest of the hydrocarbon stream. Oxidation has been found to be beneficial because oxidized sulfur compounds can be removed using a variety of separation processes that rely on the altered chemical properties such as the solubility, volatility, and reactivity of the sulfone compounds.

Oxidation techniques for converting thiophenes to sulfones vary and include: contact with a mixture hydrogen peroxide and a carboxylic acid to produce sulfones, which are then degraded by thermal treatment to volatile sulfur compounds; the oxidation of thiophene and thiophene derivatives in the presence of a dilute acid, with the sulfones being extracted using a caustic solution; a combination of the oxidation and thermal treatment steps with hydrodesulfurization; a two-step oxidation and extraction method extracting with a paraffinic hydrocarbon comprising a 3-6 carbon alkane; and various catalytic oxidation processes Techniques for the removal of the sulfones or "sulfone oil" include extraction, distillation, and adsorption. Another strategy involves decomposing the sulfones compounds catalytically thereby bypassing the separation process altogether.

An intrinsic problem of oxidative desulfurization lies in the disposal of the sulfones. If the sulfones are hydrotreated, they may be converted back to the original dibenzothiophene compounds thereby regenerating the original problem. Therefore, oxidative desulfurization is preferably used as a polishing step after hydrodesulfurization (HDS) or hydrotreatment. The feed sulfur content is likely to be in the range of 100 to 300 ppmw sulfur. Sulfur, on average, comprises about 15 wt % of substituted and unsubstituted dibenzothiophene molecules. Therefore, from about 0.06 to about 0.20 wt % of the oil is removed as sulfone extract. For typical refinery producing 40,000 barrels per day of diesel, approximately 7,000 to 20,000 pounds per day of sulfone oil will be generated, which is too much to dispose conventionally as a waste product. Further, the disposal of sulfone oil also wastes valuable hydrocarbons, which could theoretically be recycled if an efficient process were available.

Therefore, there is a need for a process for regenerating or recycling sulfone oil thereby avoiding disposal problems associated with the sulfone oil waste stream.

SUMMARY OF THE DISCLOSURE

A method for regenerating sulfone oil extracted from a hydrocarbon fuel stream, such as a diesel stream, that has been subjected to an oxidative desulfurization is disclosed. The fuel stream, that includes a sulfur content in the form of one or more thiophenes, is subjected to an oxidative desulfurization that results in the thiophenes being oxidized to sulfones. Sulfones are relatively easy to separate or extract from a diesel phase. Using a solvent or sorbent, sulfones are extracted from the fuel phase provide a sulfone-rich oil and a low-sulfur fuel stream. The sulfone-rich oil is then subjected to another oxidative process, preferably using a caustic stream such as a caustic waste stream or a fresh caustic stream, preferably including sodium hydroxide Sodium hydroxide oxidizes the sulfones to various unsubstituted and substituted biphenyls and sodium sulfite ($Na_2SO_3$) Hydrogen is also transferred from the hydrocarbon fuel to from the biphenyls, although the transferred hydrogen is a relatively small amount and does not significantly alter the properties of the hydrocarbon fuel. The biphenyls and the aqueous sulfide phase may be easily separated in a settler vessel where the biphenyls are recycled with low-sulfur fuel stream and the sodium sulfite aqueous phase is either disposed of or used elsewhere.

In a refinement, the fuel stream is a diesel stream. In an alternative refinement, the fuel stream is a kerosene stream.

Accordingly, in one aspect, a method for regenerating sulfone oil, that results from a sulfone extraction from a diesel stream that has been subject to an oxidative desulfurization, is shown and described. The disclosed method for regenerating sulfone oil comprises combining a sulfone-rich oil with sodium hydroxide to form sodium sulfite and biphenyls, followed by removing the sodium sulfite or separating the sodium sulfite from the biphenyls and recycling the biphenyls as fuel Alternatively, another caustic material such as potassium hydroxide may be used Other caustics and other oxidants may be employed A preferred oxidant for converting the thiophenes to sulfones is hydrogen peroxide.

The sulfone-rich oil may comprise diphenyl sulfone and substituted diphenyl sulfones The biphenyls may comprise unsubstituted biphenyl and substituted and various substituted biphenyls In a refinement, the combining of the sulfone-rich oil with sodium hydroxide further comprises combining a sulfone-rich oil extraction stream with a caustic waste stream In an alternative refinement, a fresh caustic stream is used.

In another refinement, after the sulfone-rich oil is combined with aqueous oxidant or hydroxide, a two phase system is present. The two phase system is delivered to a settler vessel to facilitate the separating of the aqueous sulfite solution from the substantially sulfur-free fuel mixture that comprises biphenyl and various substituted biphenyls.

In a refinement, the sulfone-rich oil is combined with caustic at a temperature ranging from about 40 to about 120° C. at a pressure ranging from about 0.5 to about 15 atm and wherein the caustic is provided in the form of aqueous solution of sodium hydroxide (or other caustic material) at a concentration ranging from about 2 to about 30 mol %.

In another refinement, the sulfone-rich oil is provided while extracting sulfones from a sulfone-rich fuel stream by mixing the sulfone-rich stream with a solvent selected from the group consisting of water, methanol, dimethylformamide, acetonitrile, an ionic liquid, polyethylene glycol, mixtures thereof as well as other polar solvents which results in a substantially sulfone-free fuel and a sulfone-rich oil which comprises solvent and sulfones In another refinement, the solvent to fuel volumetric ratio ranges from about 0.1 to about 10.

In another refinement, the fuel is diesel and the sulfone-rich diesel is provided by oxidizing the thiophenes in a thiophene-rich diesel to sulfones to provide sulfone-rich diesel The oxidation temperature ranges from about 40 to about 120° C. The oxidation pressure ranges from about 0.5 to about 15 atm. The oxidant can be selected from the group consisting of alkylhydroperoxides, per oxides, percarboxylic acids, oxygen, air and mixtures thereof. A molar ratio of the oxygen to thiophene can range from about 1 to about 100.

Other advantages and features will be apparent from the following detailed description when read in conjunction with the attached drawings including the application of the disclosed techniques to streams other than diesel such as kerosene and the use of oxidants other than sodium hydroxide

BRIEF DESCRIPTION OF THE DRAWINGS

For a more complete understanding of the disclosed methods and apparatuses, reference should be made to the flow diagram of FIG. 1

DETAILED DESCRIPTION OF THE PRESENTLY PREFERRED EMBODIMENTS

Figure 1:
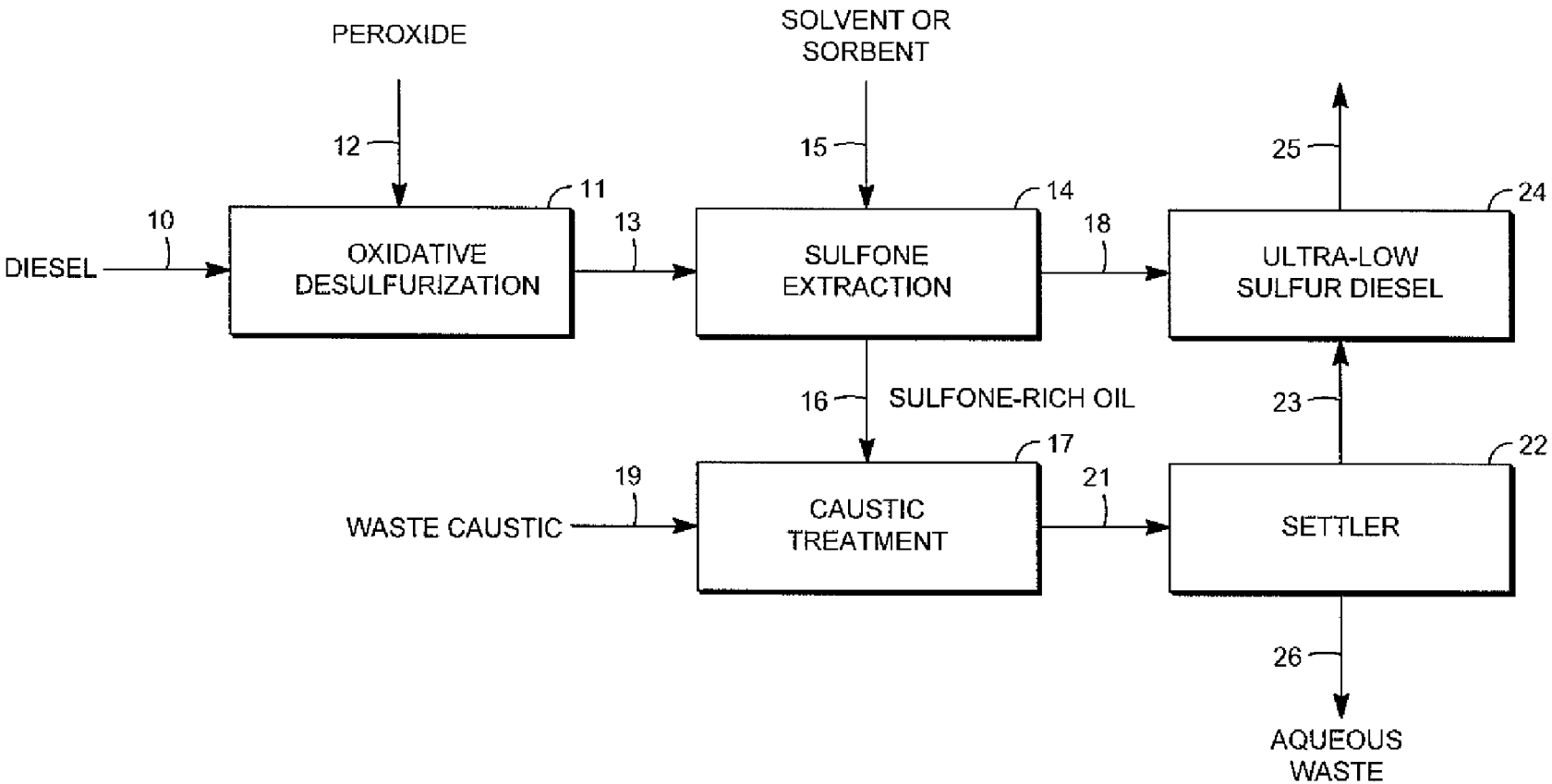

As shown in FIG. 1, a refined diesel must be subjected to desulfurization process in order to meet current and future environmental standards. In oxidated desulfurization diesel is provided through the line 10 to a mixing vessel 11 and combined with peroxide through the line 12. In the vessel 11, various thiophenes, of both the unsubstituted and substituted type are oxidized to sulfones, of both the substituted and unsubstituted types.

A preferred oxidant for treating the fuel or diesel stream is hydrogen peroxide. However, various oxidizing agents may be used including alkylhydroperoxides, other peroxides, percarboxylic acids, oxygen and air as well as combinations thereof Typically, the temperature within the vessel 11 will range from about 40 to about 120° C. The pressure within the vessel 11 will then typically range from about 0.5 to about 15 atm. Residence time of the vessel 11 will range from about 0.1 to about 50 hours. Depending upon the oxidizing agent utilized, the molar ratio of the oxidizing agent to thiophene or sulfone compound will range from about 1 to about 100

In the vessel 11, a thiophene-rich fuel or diesel stream is converted to a sulfone-rich diesel stream that exits the vessel 11 through the line 13 before entering the extraction vessel 14. Sulfones are relatively easy to extract from other hydrocarbons In the extraction vessel 14, the sulfone-rich fuel is combined with a solvent or sorbent through the line 15 which may be selected from water, methanol, dimethylformamide, acetonitrile, an ionic liquid, polyethylene glycol and mixtures thereof. The solvent or sorbent combines with the sulfones to produce a sulfone-rich oil that exits the vessel 11 through the line 16. The sulfone-rich oil passes through the line 16 into a caustic treatment vessel 17 and the remaining sulfur-free fuel, in this case diesel, passes from the extraction vessel 14 through the line 18.

While the sulfone-rich oil is extracted and passed through the line 16 to the vessel or reactor 17, the caustic stream is passed to the vessel 17 through the line 19. As indicated in FIG. 1, the caustic stream may be a waste caustic stream such as from a mercaptan pretreatment, oxidation or extraction unit. A fresh caustic stream may be utilized as well and basic materials other than sodium hydroxide such as potassium hydroxide may be utilized for oxidizing or converting the sulfones to biphenyls. The caustic or oxidant enters the vessel 17 through the line 19 where the sulfones are converted to biphenyls (unsubstituted and substituted) and sulfites (e.g., sodium sulfite, potassium sulfite, etc.). The caustic treatment vessel 17 is operated at a temperature ranging from about 40 to about 120° C. and at a pressure of about 0.5 to about 15 atm. The concentration of oxidant or the caustic concentration can range from about 2 to about 30 mol %. The residence time can range from about 0.1 to about 50 hours.

A two phase system is generated in the caustic vessel 17, including a low-sulfur diesel phase comprising biphenyls and an aqueous sulfite-rich phase. The two phases pass through the line 21 to the settler vessel 22 where the biphenyl-rich phase which serves as a low-sulfur fuel (e.g., diesel) phase passes through the line 23 may be combined with the low-sulfur fuel phase generated by the sulfone extraction vessel 14. Otherwise, the low-sulfur fuel may be stored at 24 or passed through a recirculation line at 25. Aqueous sulfite-rich waste passes through line 26.

In the oxidative desulfurization vessel 11, the operating temperature ranges from about 40 to about 120° C. and a pressure ranging from about 0.5 to about 15 atm. The oxidizing agent may include any one or more from the group consisting of alkylhydroperoxides, peroxides, percarboxylic acids, oxygen, air and mixtures thereof. The molar ratio of oxidant to thiophene or sulfone should fall within the range of about 1 to about 100 The residence time of the vessel/reactor 11 should range from 0.1 to about 50 hours.

Regarding the sulfone extracting vessel 14, the temperature and pressure may fall within the same ranges as for the oxidative desulfurization vessel/reactor 11 and caustic treatment vessel 17. The solvents or sorbents may be selected from the group consisting of but not limited to, water, methanol, dimethylformamide, acetonitrile, an ionic liquid, polyethylene glycol and mixtures thereof. A volumetric ratio of solvent/sorbent to diesel should fall within the range from about 0.1 to about 10.

The sulfone oil may be removed in the vessel 14 by extraction, absorption or fractionation. As an alternative, the caustic solution may be contacted directly with the diesel/sulfone mixture in the vessel 14 in which the biphenyl or hydrocarbon formed by the breakdown of the sulfones will be returned directly to the fuel phase passed through the line 18 storage 24 or transport 25. Thus, the sulfone extraction carried out in the vessel 14 may eliminated entirely Thus, the process for regenerating sulfone oil by reaction with sodium hydroxide, potassium hydroxide or other suitable oxidant/caustic is provided that removes sulfur and regenerates the hydrocarbon, typically in the form of various biphenyls Because a typical refinery will include numerous waste streams that include sodium hydroxide, such as a mercaptan oxidation process or an acid wash neutralization, caustic streams are available and therefore it is preferred to employ a caustic waste stream when possible for economic reasons Caustic waste streams can be classified depending on the acidic compound that they have been used to remove Caustic streams that have been removed for hydrogen sulfide removal are described as sulfidic caustic and would not be suitable for this particular application. Caustic streams that have been used to remove naphthenic acids (naphthenic caustic) or phenyls (phenolic caustic) are suitable as the sodium hydroxide in these caustic sources is more weakly bound to the weaker acids and will preferentially react with the sulfones. If a suitable waste caustic stream is not available, a fresh caustic stream may also used.

While only certain embodiments have been set forth, alternatives and modifications will be apparent from the above description to those skilled in the art such as the application of the disclosed techniques and apparatus to kerosene and other fuel streams and the use of other oxidants for converting sulfones to biphenyls other than caustic These and other alternatives are considered equivalents and within the spirit and scope of this disclosure and the appended claims.

The invention claimed is:

1. A method for regenerating sulfone oil comprising:

combining a sulfone-rich oil with an aqueous hydroxide to convert sulfones to a sulfite and biphenyls;

removing the sulfite; and recycling the biphenyls as fuel.

2. The method of claim 1 wherein the sulfone-rich oil comprises diphenylsulfone and substituted diphenylsulfones.

3. The method of claim 2 wherein the biphenyls comprise unsubstituted biphenyl and substituted biphenyls.

4. The method of claim 1 wherein the combining of the sulfone-rich oil with the hydroxide comprises combining the sulfone-rich oil with a caustic stream.

5. The method of claim 4 wherein the caustic stream is a caustic waste stream.

6. The method of claim 1 wherein sulfone-rich oil is provided by combining a thiophene-rich stream with an oxidant-rich stream for oxidizing thiophenes to sulfones followed by extracting the sulfone-rich oil with one of a solvent or sorbent.

7. The method of claim 1 wherein the removing of the sulfite comprises delivering the sulfite and fuel to a settler vessel and separating an aqueous sulfite solution from a substantially sulfur-free fuel mixture.

8. The method of claim 1 wherein the combining of sulfone-rich oil with the hydroxide is carried out at a temperature ranging from about 40 to about 120° C. at a pressure ranging from about 0.5 to about 15 atm and wherein the hydroxide is aqueous sodium hydroxide at a concentration ranging from about 2 to about 30 mol %.

9. The method of claim 1 wherein the sulfone-rich oil is provided by extracting sulfones from a sulfone-rich diesel by mixing the sulfone-rich diesel with a solvent selected from the group consisting of water, methanol, dimethylformamide, acetonitrile, an ionic liquid, polyethylene glycol and mixtures thereof to provide a substantially sulfone-free diesel and the sulfone-rich oil which comprises the solvent and sulfones and wherein a solvent to diesel volume ratio ranges from about 0.1 to about 10.

10. The method of claim 9 wherein the sulfone-rich diesel is provided by oxidizing thiophenes in a thiophene-rich diesel to sulfones to provide the sulfone-rich diesel at a temperature ranging from about 40 to about 120° C., a pressure ranging from about 0.5 to about 15 atm, using an oxidant selected from the group consisting of alkylhydroperoxides, peroxides, percarboxylic acids, oxygen, air and mixtures thereof, and using a molar ratio of oxidant to thiophene compound ranging from about 1 to about 100.

11. A method for regenerating sulfone oil comprising:

combining and mixing a sulfone-rich oil with aqueous caustic thereby oxidizing sulfones in the sulfone-rich oil to one or more hydrocarbons and forming sulfite to provide a substantially sulfur-free diesel phase and an aqueous sulfite phase;

separating the aqueous sulfite phase from the diesel phase; and recycling the diesel phase.

12. The method of claim 11 wherein the sulfone-rich oil comprises diphenylsulfone and substituted diphenylsulfones.

13. The method of claim 12 wherein the diesel phase comprises biphenyl and substituted biphenyls.

14. The method of claim 11 wherein the combining of the sulfone-rich oil with caustic further comprises combining a sulfone-rich oil extraction stream with a caustic waste stream.

15. The method of claim 11 wherein the combining of the sulfone-rich oil with caustic further comprises combining a sulfone-rich oil extraction stream with an aqueous stream comprising sodium hydroxide.

16. The method of claim 11 wherein sulfone-rich oil is provided by combining a thiophene-rich stream with a oxidant-rich stream for oxidizing thiophenes to sulfones followed by extracting the sulfone-rich oil with one of a solvent or sorbent.

17. The method of claim 11 wherein the separating of the aqueous sulfite phase from the diesel phase comprises delivering the aqueous sulfite and diesel to a settler vessel and separating an aqueous sulfite from a substantially sulfur-free diesel mixture.

18. A method for desulfurizing a diesel stream, comprising:

combining a thiophene-rich diesel stream with an oxidant stream to oxidize thiophenes to sulfones to provide a sulfone-rich diesel stream;

extracting a sulfone oil stream from sulfone-rich diesel stream to provide the sulfone oil and a first low-sulfur diesel steam;

combining the sulfone-rich oil stream with an aqueous hydroxide stream thereby oxidizing sulfones in the sulfone-rich oil stream to biphenyls and forming sulfite to provide a second low-sulfur diesel stream and an aqueous sulfite stream;

separating the aqueous sulfite stream from the second low-sulfur diesel stream; and recycling the first and second low-sulfur diesel streams.

19. The method of claim 18 wherein the combining of sulfone-rich oil stream with the caustic stream is carried out at a temperature ranging from about 40 to about 120° C. at a pressure ranging from about 0.5 to about 15 atm and wherein the caustic stream comprises aqueous sodium hydroxide at a concentration ranging from about 2 to about 30 mol %.

20. The method of claim 18 wherein the extracting of the sulfone-rich oil stream from the sulfone-rich diesel stream is carried out by mixing the sulfone-rich diesel stream with a solvent selected from the group consisting of water, methanol, dimethylformamide, acetonitrile, an ionic liquid, polyethylene glycol and mixtures thereof to provide the first low-sulfur diesel stream and the sulfone-rich oil stream which comprises the solvent and sulfones and wherein a solvent to diesel volume ratio ranges from about 0.1 to about 10.

* * * * *